US006087921A

United States Patent [19]

Morrison

[11] Patent Number: 6,087,921

[45] Date of Patent: Jul. 11, 2000

[54] PLACEMENT INSENSITIVE MONOLITHIC INDUCTOR AND METHOD OF MANUFACTURING SAME

[75] Inventor: Timothy Morrison, Oceanside, Calif.

[73] Assignee: Pulse Engineering, Inc., San Diego, Calif.

[21] Appl. No.: 09/168,525

[22] Filed: Oct. 6, 1998

[51] Int. Cl.[7] ..... H01F 5/00; H01F 27/29

[52] U.S. Cl. ..... 336/200; 336/192; 336/233

[58] Field of Search ..... 336/200, 223, 336/232, 192, 233

[56] References Cited

U.S. PATENT DOCUMENTS

| | | | |
|---|---|---|---|
| 1,767,715 | 6/1930 | Stoekle . | |
| 2,913,640 | 11/1959 | Edgarton . | |
| 3,585,553 | 6/1971 | Muckelroy et al. . | |
| 3,874,075 | 4/1975 | Lohse | 29/602 |
| 4,253,231 | 3/1981 | Nouet | 29/602 |
| 4,597,169 | 7/1986 | Chamberlin | 29/605 |
| 4,758,808 | 7/1988 | Sasaki et al. | 333/185 |
| 5,003,279 | 3/1991 | Morinaga et al. . | |
| 5,051,712 | 9/1991 | Naito et al. | 336/200 |
| 5,173,670 | 12/1992 | Naito et al. | 336/200 |
| 5,359,315 | 10/1994 | Inoue et al. . | |
| 5,572,180 | 11/1996 | Huang et al. | 336/200 |
| 5,764,126 | 6/1998 | Kanetaka et al. | 336/96 |
| 5,781,093 | 7/1998 | Grandmont et al. | 336/232 |

FOREIGN PATENT DOCUMENTS

| | | | |
|---|---|---|---|
| 0 025 605 A1 | 9/1980 | European Pat. Off. . | |
| 3042 433 A1 | 7/1982 | Germany . | |
| 3938718 | 5/1991 | Germany | 336/200 |
| 55-091804 | 11/1980 | Japan | H01F 5/00 |
| 56-160014 | 12/1981 | Japan . | |
| 58-79706 | 5/1983 | Japan . | |
| 62-9607 | 1/1987 | Japan . | |
| 4-216603 | 8/1992 | Japan . | |
| 5-343238 | 12/1993 | Japan | 336/200 |
| 5-347211 | 12/1993 | Japan | 336/200 |
| 8-055728 | 6/1996 | Japan . | |
| 68073 | 10/1972 | Luxembourg . | |
| 397536 | 2/1933 | United Kingdom . | |

*Primary Examiner*—Lincoln Donovan
*Assistant Examiner*—Ann Mai
*Attorney, Agent, or Firm*—Knobbe, Martens, Olson & Bear, LLP

[57] ABSTRACT

A monolithic inductor comprises an elongated substrate having opposite distal ends and, each end having an end cap extending radially from the respective end to support the substrate in spaced relation from a PC board, each end cap having a plurality of intersecting planar surfaces defining corners, an electrically conductive layer forming a winding on the substrate and extending between the opposite ends to provide a winding, and an electrically conductive soldering pad extending partially around at least some of the corners of said end caps at each end of the substrate in electrical contact with the conductive layer, each soldering pad providing a terminal on each of the intersecting planar surfaces.

16 Claims, 3 Drawing Sheets

PLACEMENT INSENSITIVE MONOLITHIC INDUCTOR AND METHOD OF MANUFACTURING SAME

BACKGROUND OF THE INVENTION

The present invention relates to miniature inductors and pertains particularly to improved monolithic inductors and a method of manufacturing the same.

Miniature inductors are widely used in many electric circuits and particularly in radio frequency electric circuits. The inductors are made in two basic configurations: wire wound and monolithic. Wire-wound inductors are made with a wire wound on a dielectric or a ferrite core, or they can be made free-standing, provided a wire of sufficient thickness is used to ensure stability. There are several types of monolithic inductors: multilayer ceramic and ferrite, a single-layer spiral, and helical. This invention is primarily concerned with the helical type inductors.

Wire-wound inductors, especially the ones wound on dielectric cores or free-standing, generally have high Q-factor values, but are characterized by high cost. It is also relatively complicated to provide an inductor having an exact inductance value, due to the fact that the locations of wire termination points are usually fixed on a core, so fractional wire turns are sometimes not possible. One solution to this problem has been to select cores of different diameters for various inductance values, but this leads further to increased costs due to the need to adjust winding and handling machinery and the need for expanded core inventories.

In addition, the repeatability of the winding process, especially in cases where the inductance value is relatively low and only a few wire turns are required, is limited by the same need to attach the ends of the wire to the fixed locations on the core.

A helical-type monolithic inductor consists of a substrate forming an elongated ceramic or ferrite core. The substrate is covered with one or more metal layers which are then etched or cut in a helical fashion, either mechanically or with a laser beam. The cut defines a helical winding similar to a wire coil. The ends of the core usually have metal caps in electrical contact with the conducting layer. The metal caps customarily have a solderable coating defining terminals to facilitate soldering of the inductor to a printed circuit board.

It has been discovered and confirmed through extensive testing that the end caps on the current helical monolithic inductors act as shortened windings. These shortened windings introduce parasitic losses which lead to diminished Q-values and lower inductance values. It was also discovered that without continuous metallization at the end caps significantly increased Q-values, and inductance values are obtained. One approach to implementing this concept was disclosed in U.S. application Ser. No. 08/797,636 filed Feb. 11, 1997 entitled Monolithic Inductor, now allowed, assigned to the assignee hereof.

It is desirable to reduce cost of electrical components such as inductors without sacrificing performance of the systems they are made part of. It is also desirable to provide inductors as close to the stated nominal value as possible, with minimal process variations. This is known in the art as "high tolerance". Having inductors with high tolerance is desirable since it may obviate the use of tunable components, such as inductors and capacitors in end products. One problem of the prior devices is that they are expensive to manufacture in a way to make them placement insensitive, otherwise they must be manually placed which also makes them labor intensive and expensive to utilize.

It is desirable to have an inductor that is simple and easy to manufacture and is placement insensitive.

SUMMARY AND OBJECTS OF THE INVENTION

It is the primary object of the present invention to provide an improved monolithic inductor having placement insensitive characteristics and method of manufacturing same.

In accordance with a primary aspect of the present invention a monolithic inductor, comprises an elongated substrate having opposite distal ends and having and end cap extending from each of said opposite ends to support and space said substrate from a PC board, an electrically conductive layer formed on said substrate and extending between said opposite ends to provide a winding, and an electrically conductive soldering pads on said end caps at each end of said substrate in electrical contact with said conductive layer, each soldering pad having a portion positioned to insure electrical contact regardless of orientation on a PC board.

BRIEF DESCRIPTION OF THE PREFERRED EMBODIMENTS

The above and other objects and advantages of the present invention will become apparent from the following description when read in conjunction with the accompanying drawings wherein.

DETAILED DESCRIPTION OF THE PREFERRED EMBODIMENTS

Figure 1:
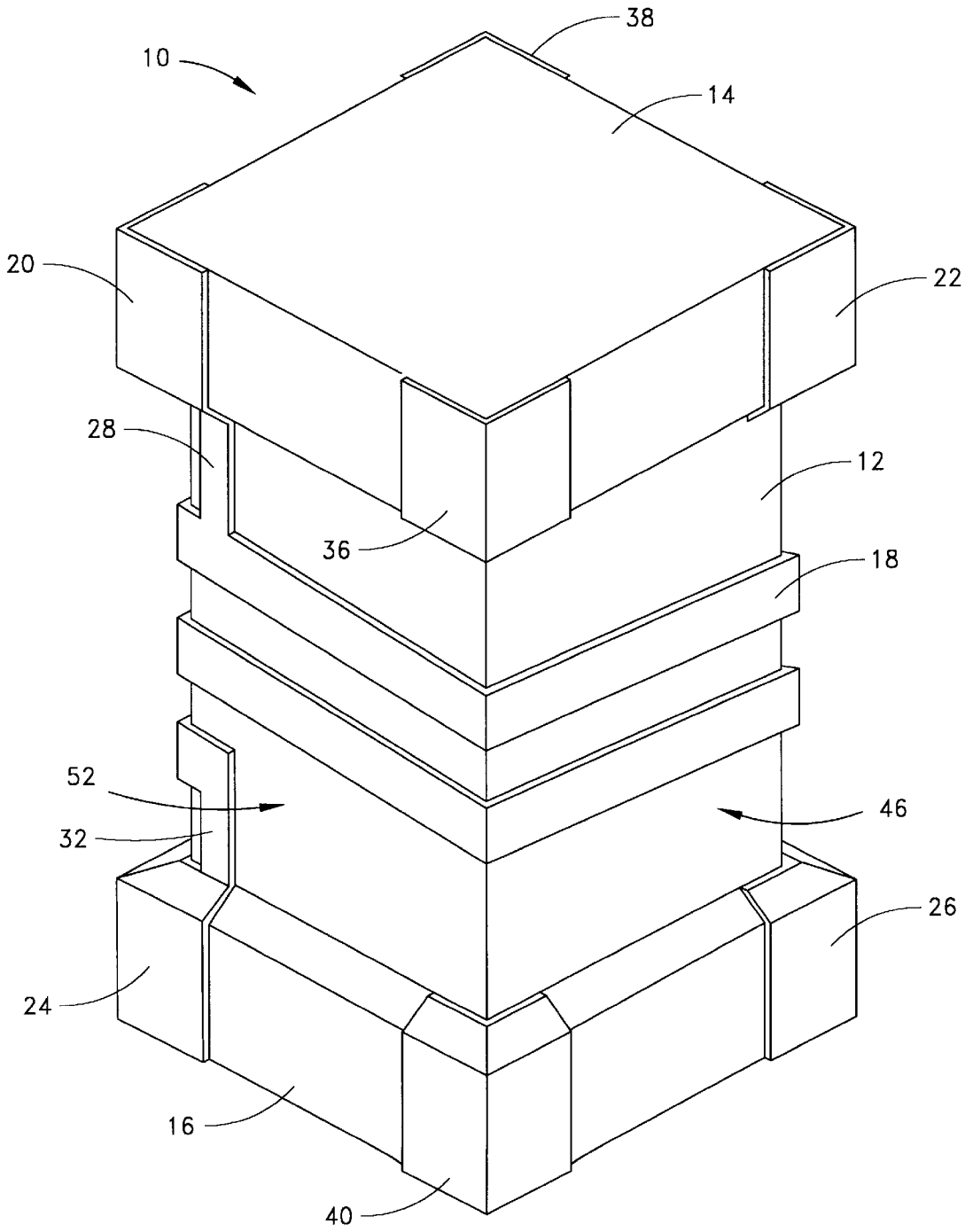
FIG. 1 is a perspective view of a monolithic inductor in accordance with an exemplary embodiment of the invention.

Referring to FIG. 1, an exemplary embodiment of a monolithic inductor constructed in accordance with the present invention is illustrated and designated generally by the numeral 10. The inductor is constructed with a support structure comprising an elongated central core or substrate which in the illustrated embodiment comprises a rectangular bar 12 with a generally square cross-section, having end caps or flanges 14 and 16 which extend radially outward beyond the surfaces of the central substrate 12. The end caps support the central portion of the substrate in spaced relation to a PC board on which it is mounted and provide a place for terminals. The core 12 in this embodiment is illustrated as having a generally square or rectangular cross-sectional configuration, but it may have other configurations such as circular. The end caps or rims are identical and are shaped and sized for ease of positioning on a PC board. As illustrated, each end cap is formed with four planar sides with four square or right angled corners.

Figure 3:
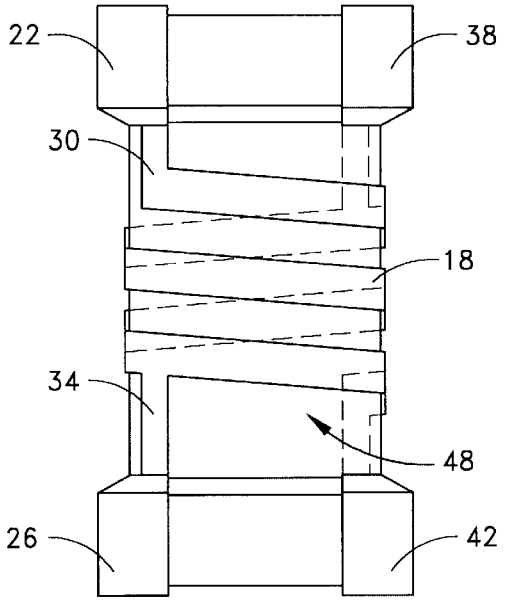
FIG. 3 is a view like FIG. 2 of a second side of the embodiment of FIG.

The central core 12 may be of any suitable material such as ceramic or ferrite. It is formed with helical conductive strip or ribbon 18 forming the winding which is electrically connected to conductive terminal bands or strips forming terminal bands 20 and 22 at diagonally opposite corners on one end or flange 14. The other end of the winding is electrically connected to conductive terminal bands or strips forming terminal bands 24 and 26 at diagonally opposite corners on the other end or flange 16. The winding 18 as seen FIG. 1 connects to terminal 20 with a shunt 28 and continues with a half turn to connect terminal end 30 with terminal 22 (FIG. 3.). The other or lower end of winding 18 as seen FIG. 1 connects at end 16 to terminal 24 with a shunt 32 with a half turn of the winding to a connection with terminal 26 (FIG. 3.). Thus, the winding connects at both ends to diagonally opposite corners of the flanges 14 and 16 where terminals which extend around the corners are located. The terminals are thereby positioned on all four faces of the end flanges so that connection can be made with a bonding pad on a PC board when lying on any of its four sides.

The inductor is also provided with corner pads 36 and 38 at diagonally opposite corners of cap 14 and pads 40 and 42 at diagonally opposite corners of cap 16. These pads are not connected into the winding of the circuit but provide mechanical support and connection to the pad on the PC board. The windings on the substrate are formed by the application of a metallization coating to the surface of the substrate including the end caps and thereafter laser cut (or other suitable method such as etching, etc.) away the coating in a spiral manner to leave conductive strip or winding 18 in the helical path as desired. The laser cut preferably starts a face of end cap 14 or 16 and extends inward to begin and continue the spiral path which progresses along the core to the shunts and pads at the corners and to the face of the other end cap. Similarly, the pads 36, 38, 40 and 42 on the end caps may be formed by laser cutting away of strips or areas of the metallized surface.

The metallization may be applied by any suitable well-known means, and any suitable conductive metal or ink may be utilized. Similarly, the substrate or core may be formed of any suitable material, such as a dielectric material, a ferrite material, or any other suitable form of metallic or ceramic materials. By way of example, the coating may comprise a tungsten underlay or coating with a second coating of nickel and a final coating of solder.

Figure 2:
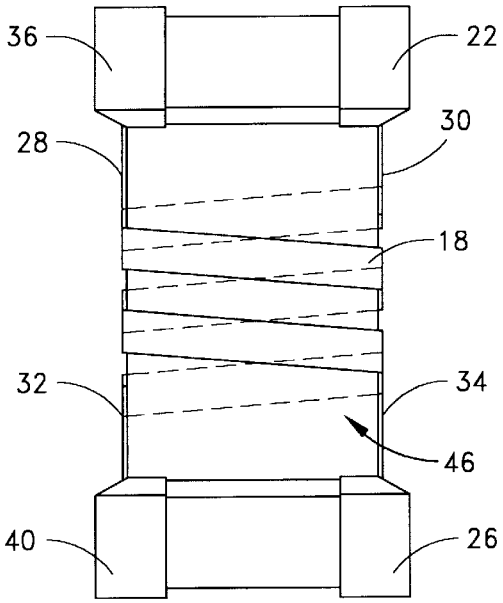
FIG. 2 is a side elevation view with hidden lines windings that can't bee seen of a first side of the embodiment of FIG. 1.

The inductor has four faces with a terminal at each end. As illustrated, a first face 46 is shown at FIG. 1 and 2 with terminals 22 and 26 connected to the winding. Terminal 22 is connected directly to the end 30 and terminal 26 is connected (½ turn short of full turn of winding 18) via shunt 34. A second face 48 is illustrated in FIG. 3 with 22 and 26 which extend around the corners shown directly connected via terminal end 30 and shunt 34 to the winding. A terminal end 30 connects the upper end of the winding to terminal pad 26 and a shunt 34 connects to terminal pad 26 a half turn short of the lower end of the winding.

Figure 4:
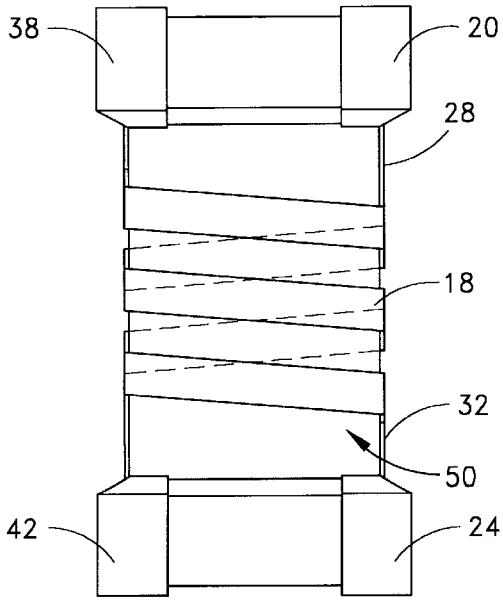
FIG. 4 is a view like FIG. 2 of a third side of the embodiment of FIG. 1.
Figure 5:
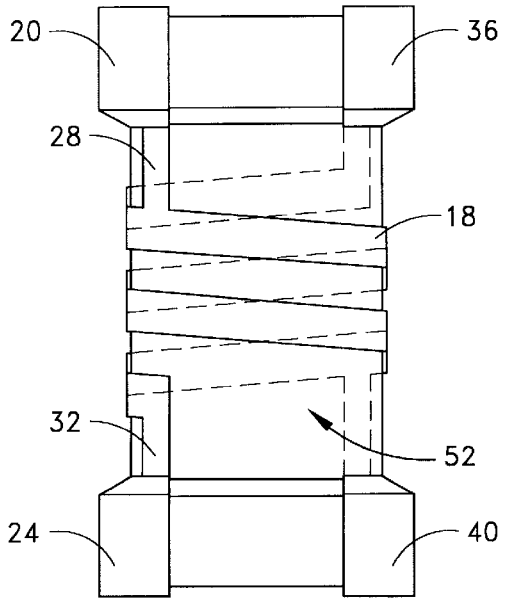
FIG. 5 is a view like FIG. 2 of a fourth side of the embodiment of FIG. 1.

A third face 50 of the inductor is illustrated at FIG. 4 with terminal pads 20 and 24 at each end with terminal 20 connected via a shunt 28 on the right side to the winding one half turn short of the upper end. The lower end of the winding is connected directly as 32 to the terminal 24. Finally, a face 52 is shown at FIGS. 1 and 5 with the terminal pads 20 and 24 at each end with shunt 28 and terminal end 30 shown connecting them to the winding. This construction enables the inductor to be placed on any one of the four sides and make connection with terminal pads on a PC board. This construction also has the advantage of the gaps in the conductors on the end caps.

Figure 6:
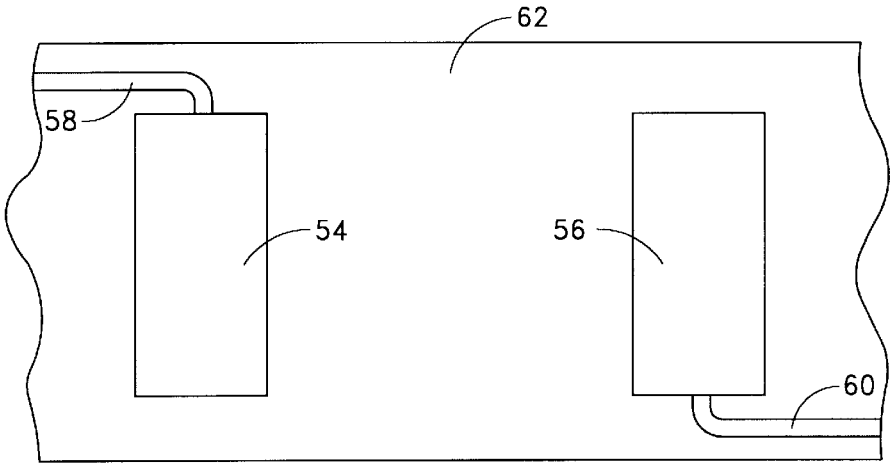
FIG. 6 is top plan view of an inductor mounting pad on a PC board.

Referring to FIG. 6 terminal pads for an inductor are illustrated at 54 and 56 with conductors 58 and 60 connecting them to a circuit not shown on a PC board 62. The terminal pads 54 and 56 are preferably wider than the end caps to provide a margin of error in the placement. The inductor may be placed on a PC board be either a machine or by hand. In any case, any side of the inductor placed on the pads will insure that it is properly connected. The winding of the inductor will also have the same length no matter which connection is made on a PC board. In other words the length of winding 18 is essentially between one terminal end and one shunt connection. When a terminal end terminal of the winding is connected to a terminal pad on one end on a particular side, a shunt connected terminal will be connected to the terminal pad on the other end on that side or face.

This terminal arrangement also provides a gap which eliminates the shortened winding effect of the terminal bands as discussed in the previously mentioned application. Thus, it eliminates the parasitic losses which lead to diminished Q-factor values, as well as lower inductive values. Inductors of this construction have been found to have about equal inductance and Q factor as wire wound inductors at much less cost in construction.

Figure 7:
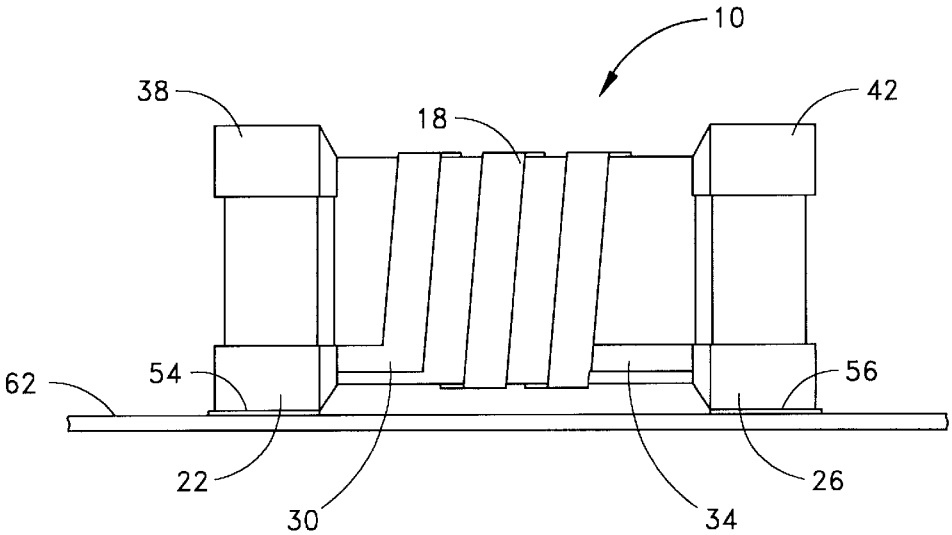
FIG. 7 is a side elevation view of an inductor of FIG. 1 shown mounted on the PC board of FIG. 6.

Referring to FIG. 7, an inductor 10 is illustrated mounted on the pads 54 and 56 of the PC board 62 with face 46 (FIG. 2) toward the board and face 48 (FIG. 3) toward the observer. As can be seen terminals 22 and 26 provide the connection of the winding to the PC board terminals. Terminal 22 is connected by terminal end 30 to the winding and terminal 26 is connected via shunt 34 to the winding.

The windings on the substrate are formed by the application of a metallization coating to the surface of the substrate and thereafter laser cutting away the coating in a spiral manner or pattern to leave conductive strip or winding 18 in the helical path as desired. The laser cut preferably starts at an end cap or may start at the inner face of one end cap 14 and extends inward to begin and continue the spiral path which progresses along the core to the face of the other end cap 16. Similarly, the terminals on the end caps may be formed by laser cutting away of a strip of the metallized surface.

The above described construction and configuration ensures that when the inductor is placed on a PC board 62 as shown in FIG. 7, the inductor, will be electrically connected to the PC board. When resting on any side, as illustrated in FIG. 7, the inductor will have a terminal connected to the terminals of the PC board.

The present invention also lends itself to procedures which ensure the manufacturing of inductors as close to the stated nominal value as possible. This eliminates the need for tunable components, such as trimmable inductors and capacitors in the end products.

In the aforementioned application, an apparatus is schematically illustrated wherein in accordance with a preferred embodiment of the process, inductance is monitored while the helical winding of the inductor is being made. The apparatus comprises a pair or dielectric mandrels which engages and supports a preform (i.e., a metallized substrate) for an inductor and rotates it during the laser machining or forming of the winding thereof. A laser beam is positioned to cut grooves into the metallized layer forming the helical conductive paths of the inductor.

While the laser is in the process of cutting the conductive windings for the inductor, a meter monitors the inductance such that the inductor is effectively custom cut to the desired inductance. When the desired inductance is reached, the winding is terminated by connection directly to the terminal bands. This eliminates the need for certain adjustability in the circuit in which the inductor is placed.

The geometry of a trace, the distance between the adjacent turns, as well as the angle the trace makes with the centerline of the coil influence characteristics of the resulting inductor. For instance, a wider conductive trace will produce an inductor with lower electrical resistance, and, therefore higher Q-value.

The helical cut can be produced by a continuous, or a rapidly pulsed laser beam while the beam is translated in a helical fashion with respect to the substrate's longitudinal axis. This is commonly achieved the substrate while a laser beam is translated along the substrate's longitudinal axis. Alternatively, a laser can be translated in a helical path around the stationary substrate.

The straight cut sections are preferably made by a laser beam translated along the longitudinal axis of the substrate, while the substrate is held stationary. Alternatively, the straight sections can be cut while the substrate is spun around its longitudinal axis, by laser pulses which impinge on the substrate at particular locations. This process requires acquisition of the angular position of the substrate prior to generating each laser pulse, so that precise placement of laser beam is possible along the periphery of the substrate, thus producing an essentially straight cut along the longitudinal axis of the substrate.

The conductive structure or winding is formed in a spiral arrangement, as previously described, such as by means of a laser cutter. This configuration with the smoother transition from the central portion of the substrate to the larger diameter end rims facilitates continuous metallization and an easy cut or formation of the spiral conductive winding from end cap to end cap.

While I have illustrated and described my invention by means of specific embodiments, it is to be understood that numerous changes and modifications may be made therein without departing from the spirit and scope of the invention, as defined in the appended claims.

I claim:

1. A monolithic inductor, comprising:

an elongated substrate having opposite distal ends and having an end cap on each of said opposite distal ends to support and space said elongated substrate from a PC board, each end cap having a plurality of intersecting planar surfaces defining corners;

an electrically conductive layer forming a winding on said elongated substrate and extending between said opposite distal ends to provide a winding; and a pair of separate electrically conductive terminals on each end cap, each pair extending around respective diagonally opposed comers of said end cap, wherein each terminal extends only part way along two of said intersecting planar surfaces, and wherein each of said terminals is in electrical contact with a selected part of said winding.

2. An inductor according to claim 1 wherein said elongated substrate is formed of dielectric material.

3. An inductor according to claim 1 wherein said elongated substrate is formed of ferrite material.

4. An inductor according to claim 1 wherein said conductive layer is a metal layer.

5. An inductor according to claim 4 wherein said metal layer is copper.

6. An inductor according to claim 1 wherein a first terminal of said pair of terminals on each of said end caps is connected to a terminal end of said winding and wherein a second terminal of said pair of terminals on each of said end caps is connected to said winding by a shunt spaced away from the terminal end of the winding.

7. An inductor according to claim 6 wherein said shunt is spaced about one-half turn from a terminal end of said winding.

8. An inductor according to claim 6 wherein said conductive layer is a metal layer.

9. An inductor according to claim 8 wherein said metal layer is copper.

10. An inductor according to claim 1 wherein said shunt is spaced about one-half turn from a terminal end of said winding.

11. An inductor according to claim 10 wherein said conductive layer is a metal layer.

12. An inductor according to claim 11 wherein said metal layer is copper.

13. A method of manufacturing an inductor, comprising:

providing a substrate having opposite distal ends and end caps disposed on each of said opposite distal ends;

coating the substrate with an electrically conductive coating;

removing areas of said conductive coating between said end caps so as to leave a conductive pattern forming a winding on said substrate;

removing areas of said conductive on side surfaces of at least one of said end caps so as to form first and second separate terminals extending around two diagonally opposed comers of said end caps;

connecting a first location on said winding to said first terminal; and connecting a second location on said winding to said second terminal.

14. A monolithic inductor, comprising:

an elongated substrate having first and second opposite distal ends and first and second end cans extending around and encircling a corresponding opposite end to support said substrate in spaced relation from a PC board, each said end cap being formed with a plurality of planar mounting areas intersecting at right angles forming corners;

an electrically conductive layer formed into a winding on said substrate extending between said opposite distal ends; and a first electrically conductive soldering pad extending around a first one of said corners of said first end cap and connected to a first location on said winding a second separate electrically conductive soldering pad extending around a second one of said corners of said first end cap and connected to a second location on said winding, said second one of said corners being diagonally opposed to said first one of said corners.

15. An inductor according to claim 14 wherein said first electrically conductive soldering pad is connected to a terminal end of said winding and said second electrically conductive soldering pad is connected to said winding by a shunt spaced from the terminal end of the winding.

16. An inductor according to claim 15 wherein said shunt is spaced about one-half turn from a terminal end of said winding.

* * * * *